US008621691B1

(12) United States Patent
Alsaffar

(10) Patent No.: US 8,621,691 B1
(45) Date of Patent: Jan. 7, 2014

(54) CHAIR/BED FOR THE DISABLED

(71) Applicant: Abdulreidha Abdulrasoul Alsaffar, Mubarak Alkabeer (KW)

(72) Inventor: Abdulreidha Abdulrasoul Alsaffar, Mubarak Alkabeer (KW)

( * ) Notice: Subject to any disclaimer, the term of this patent is extended or adjusted under 35 U.S.C. 154(b) by 0 days.

(21) Appl. No.: 13/898,445

(22) Filed: May 20, 2013

(51) Int. Cl.
*A47C 1/02* (2006.01)

(52) U.S. Cl.
USPC ..... 5/613; 5/618; 5/933

(58) Field of Classification Search
USPC ..... 5/933, 944, 613, 503.1, 618, 600
See application file for complete search history.

(56) References Cited

U.S. PATENT DOCUMENTS

| | | | | |
|---|---|---|---|---|
| 2,656,876 | A | 10/1953 | Larrick | |
| 2,753,920 | A | 7/1956 | Ranger | |
| 3,284,126 | A * | 11/1966 | Piazza | 296/20 |
| 4,787,104 | A * | 11/1988 | Grantham | 5/613 |
| 7,086,108 | B1 * | 8/2006 | Litvak | 5/723 |

* cited by examiner

*Primary Examiner* — Fredrick Conley
(74) *Attorney, Agent, or Firm* — Richard C. Litman

(57) ABSTRACT

The chair/bed for the disabled is a wheeled, medical appliance for disabled persons that can alternately convert from a chair to a bed when desired. The appliance incorporates structure for applying body massages and for moving the patient in a rollover motion. Ancillary features, such as a pillow, a night light, study and dining tables and a support for mounting a television or tablet are included on the appliance. A control module is provided to allow the appliance to be operated by a remote control device.

15 Claims, 5 Drawing Sheets

CHAIR/BED FOR THE DISABLED

BACKGROUND OF THE INVENTION

1. Field of the Invention

The present invention generally relates to medical appliances, and particularly to a chair/bed that can alternately function as a chair or bed for use by disabled persons.

2. Description of the Related Art

Disabled patients in hospitals, nursing homes, or in-home are often required to be moved from a prone to a sitting position for various medical or therapeutic procedures. The patient may also require massaging or change of position to enhance blood circulation and to avoid problems such as bed sores and the like. Moving the patient is sometimes an arduous task for the nurse or caregiver especially if the patient is obese. In many instances, moving the patient results in strains or pulls to the muscles of the back and/or arms of the nurse or caregiver. The related art discloses many appliances that convert from a bed to a chair. Unfortunately, the related art appliances are cumbersome, often lack mobility and do not provide other desirable features. Thus, a chair/bed for the disabled solving the aforementioned problems is desired.

SUMMARY OF THE INVENTION

The chair/bed for the disabled is a wheeled medical appliance for disabled persons that can alternately convert from a chair to a bed when desired. The appliance incorporates structure for applying body massages and for moving the patient in a rollover motion. Ancillary features such as a pillow, a night light, study and dining tables and a support for mounting a television or tablet are included on the appliance. A control module is provided to allow the appliance to be operated by a remote control device.

Accordingly, the invention presents a unique, convertible, medical appliance that allows a disabled person to move from a prone to a sitting position without assistance from another person. The appliance also provides structure for applying massages and for automatic movement of the patient periodically, to enhance circulation and prevent bed sores. The appliance is easy to use and incorporates features that are controllable by a remote device. The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
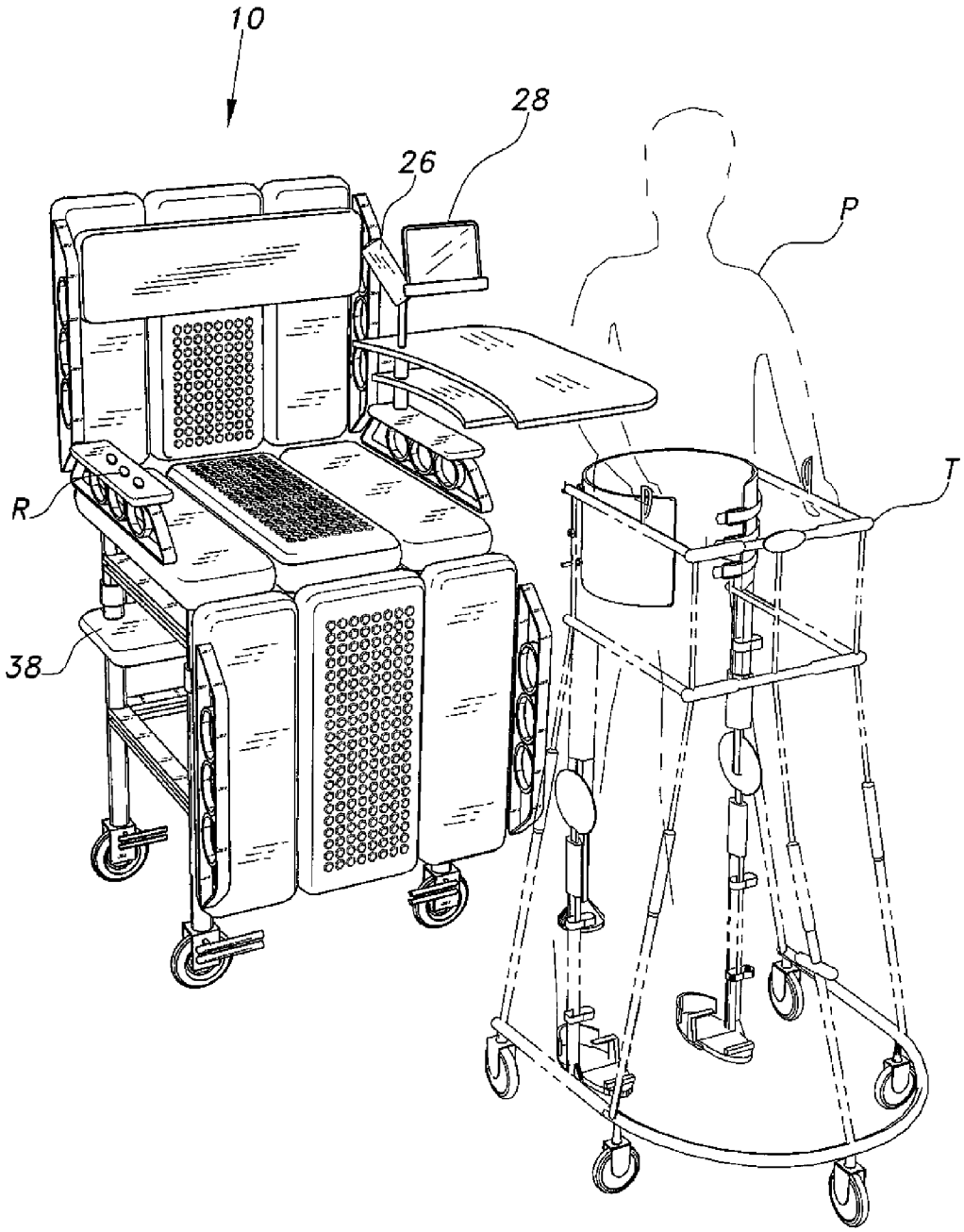
FIG. 1 is an environmental, perspective view of a chair/bed for the disabled according to the present invention.
Figure 2:
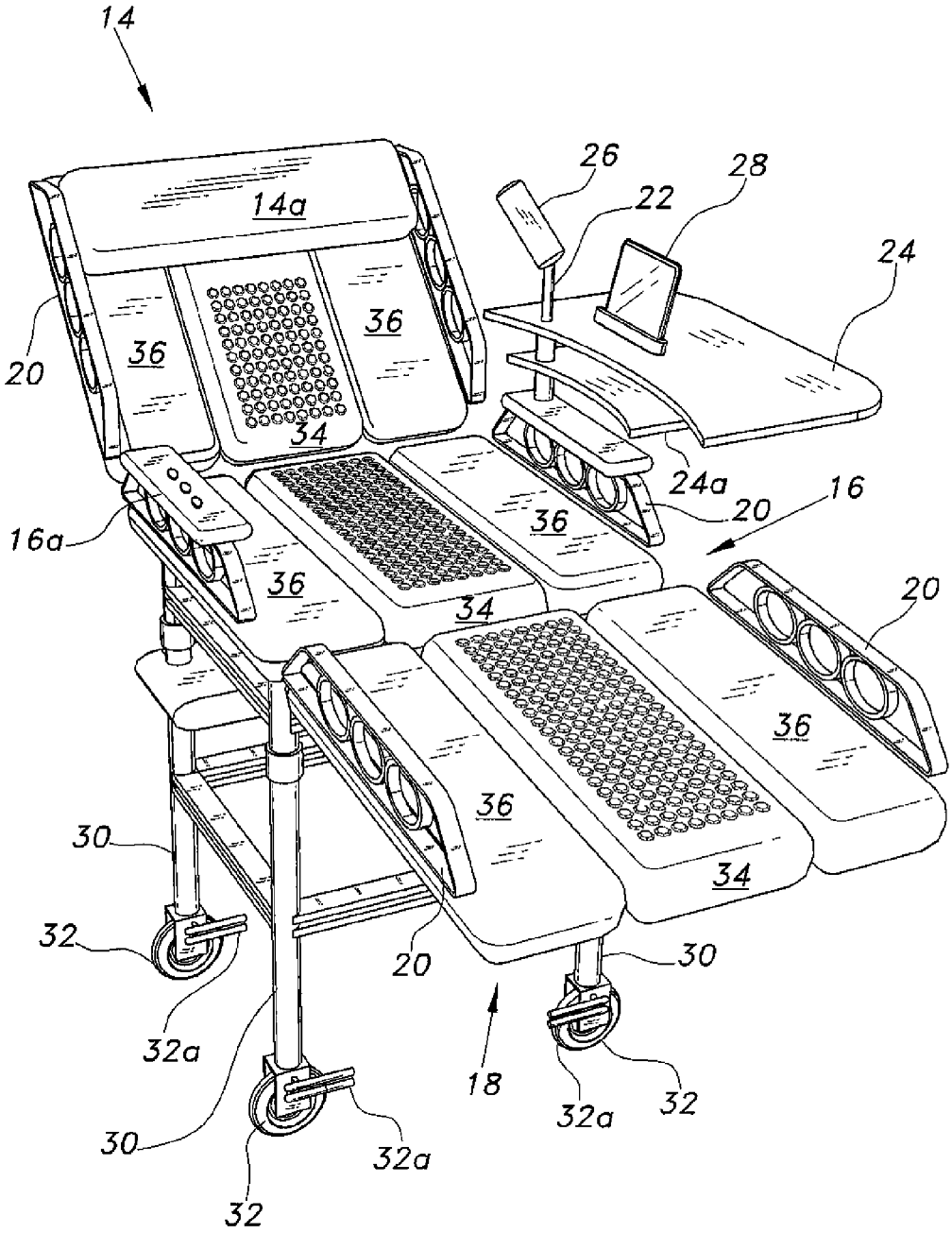
FIG. 2 is a perspective view of the chair/bed of FIG. 1 configured as a chair.
Figure 3:
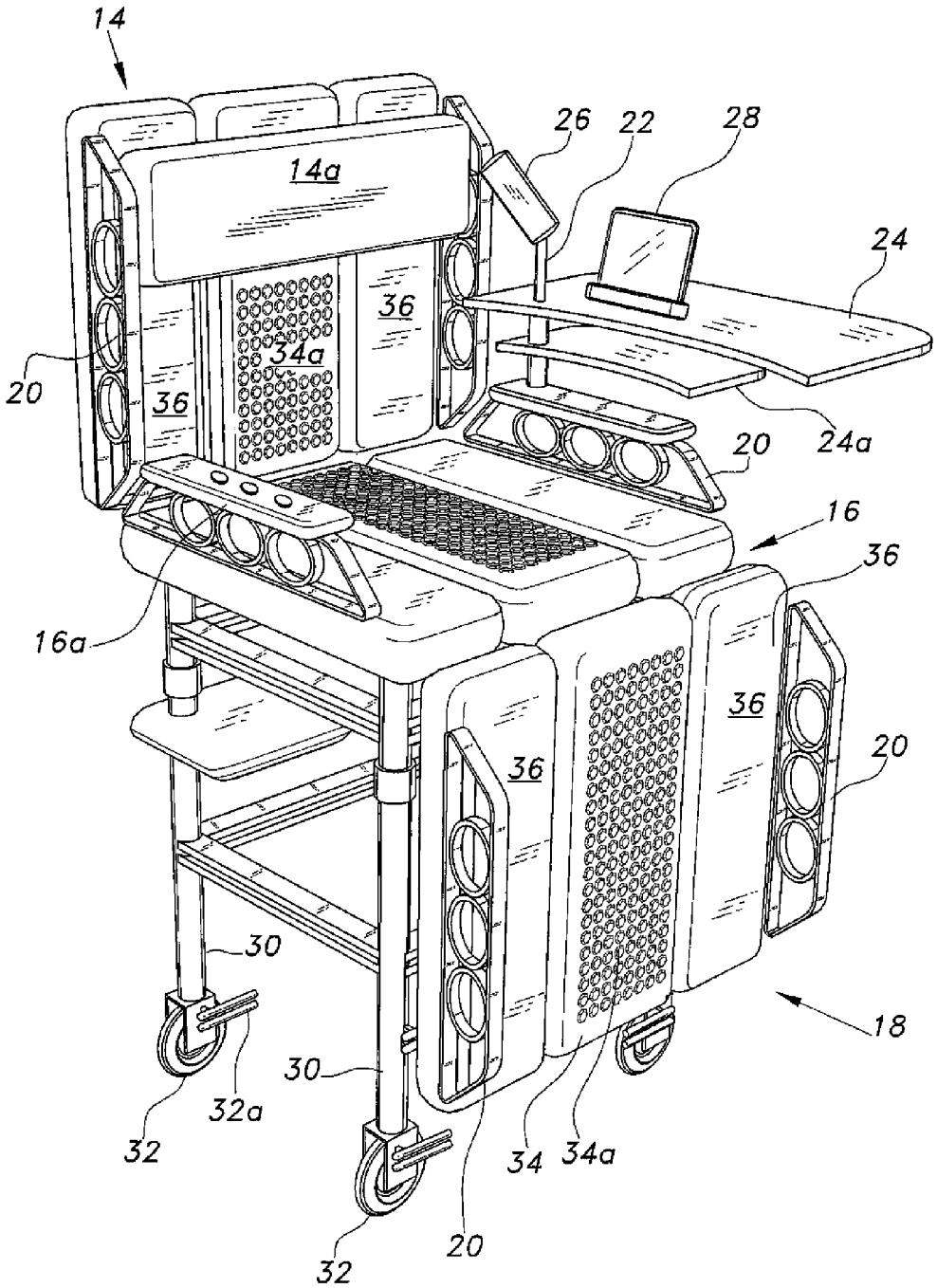
FIG. 3 is a perspective view of the chair/bed of FIG. 1 configured as a bed.

Referring to FIGS. 1-3, the chair/bed for the disabled is generally indicated at 10. The chair/bed 10 is adapted for use with a mobile transport assembly T, shown in phantom lines. Mooring devices (not shown) may be provided to secure the transport assembly T to the chair/bed 10. The assembly T is fully disclosed and claimed in the present inventor's co-pending U.S. patent application Ser. No. 13/762,263, filed Feb. 7, 2013, and is not part of the presently claimed invention.

The chair/bed appliance 10 comprises three segments 14, 16 and 18. Segment 14 is adapted to support the head shoulders and back of the disabled patient P. To enhance patient comfort, a pillow 14*a* is disposed at one end of segment 14. The other end of segment 14 is pivotally attached to an end of segment 16. Segment 16 is arranged to support the lower back, buttocks and thighs of the patient. The other end of segment 16 is pivotally attached to an end of segment 18. Segment 16 is provided with a pair of padded armrests at 16*a*. Segment 18 supports the legs and feet of the patient. Guard rails 20 are positioned along the sides of each segment to prevent the patient from accidently falling from the appliance. A post 22 is attached to one of the armrests 16*a*. The post 22 is utilized as an anchor for pivotally mounting upper and lower tables 24, 24*a* thereon. The tables 24, 24*a* may be employed as a support for food trays, books, beverage containers and the like. The post 22 can also support a night light 26 and any one of several removable electronic devices 28, such as a small TV, computer, or tablet.

Four supporting legs 30 extend downward from the underside of segment 16. Each leg terminates at its lower end in a wheel member 32 to provide mobility for the chair/bed appliance. Each wheel member 32 is equipped with a conventional brake 32*a* for safety purposes.

Figure 4:
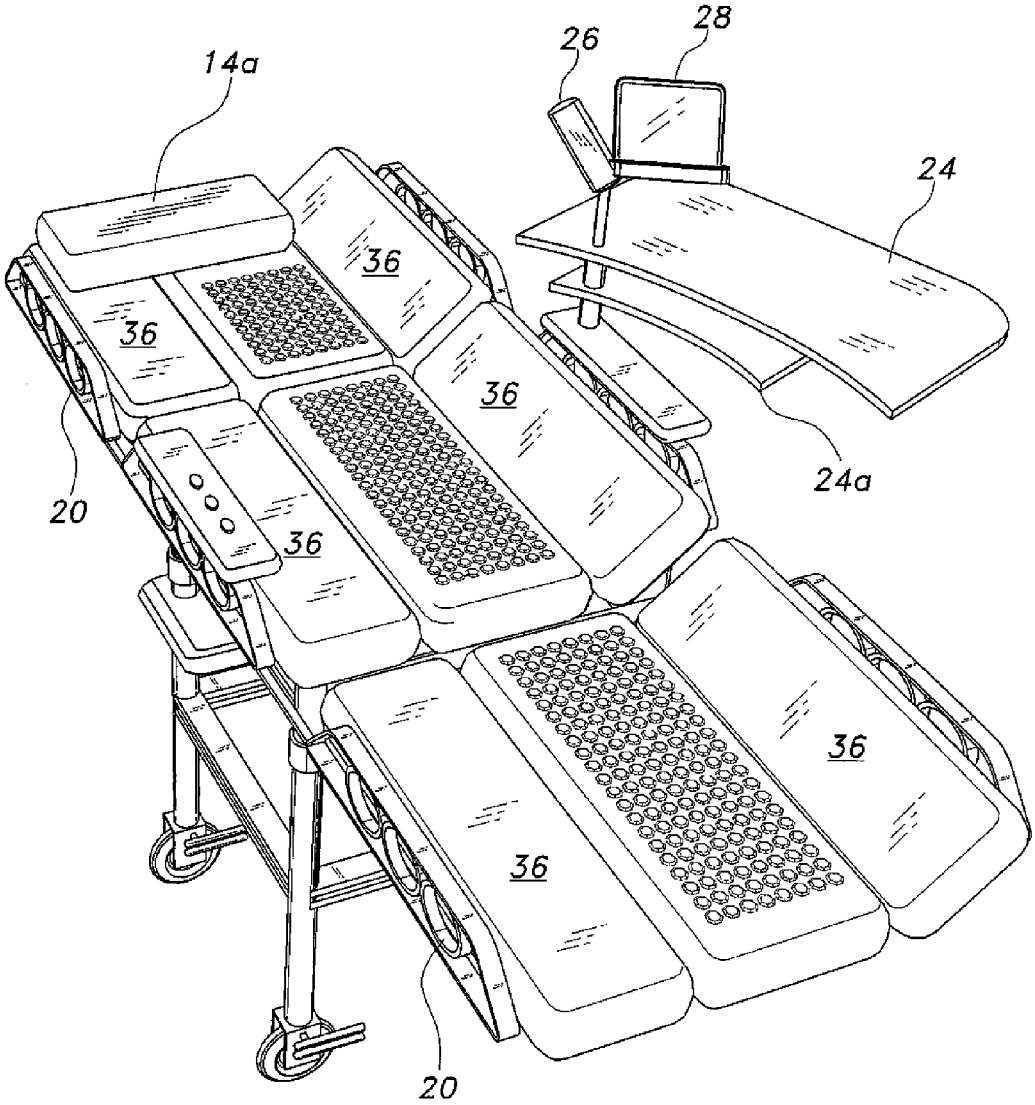
FIG. 4 is a perspective view of the chair/bed of FIG. 1 showing positioning members arranged to roll a patient to the right.
Figure 5:
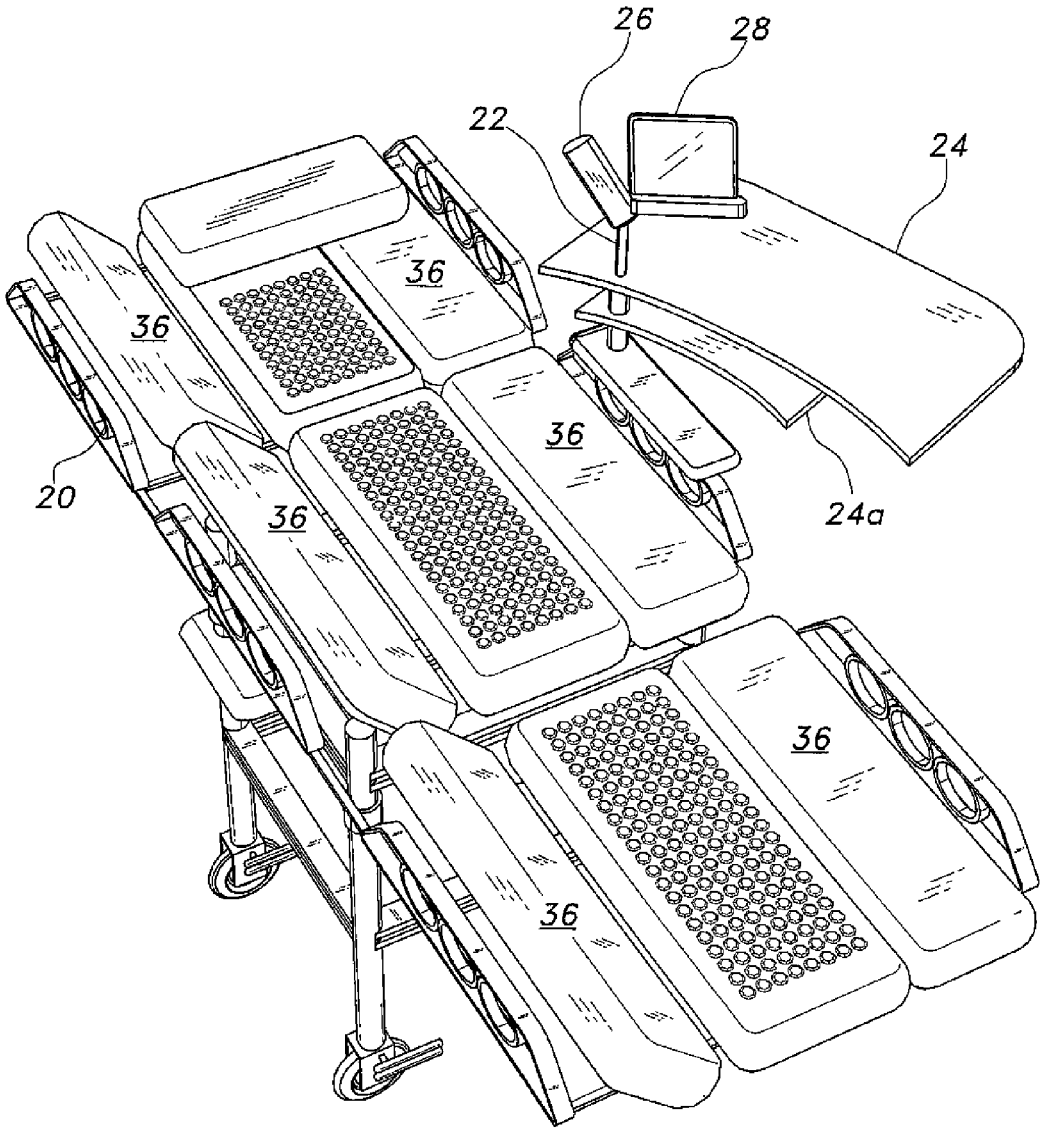
FIG. 5 is a perspective view of the chair/bed of FIG. 1 showing positioning members arranged to roll a patient to the left.

Each segment 14, 16, 18 has identically configured respective center panels 34. Each center panel 34 comprises an array of soft beads 34*a*. The beads 34*a* are made to rotate and vibrate to effectively massage the entire body of the patient. Each center panel 34 is flanked on both sides by respective pivoting positioning panels 36. As best seen in FIGS. 4 and 5, the positioning panels 36 can be pivoted along a longitudinal axis adjacent to the center panels 34 to provide an assist when adjusting the patient's position on the appliance. In FIG. 4, the positioning panels 36 on one side have been pivoted upward to roll the patient to the right. In FIG. 5, the positioning panels 36 on one side have been pivoted upward to roll the patient to the left. Movement of the segments 14, 16, 18, the massaging beads 34*a*, and the positioning panels 36 are all coordinated by way of an electronic control module 38, which provides motive signals to conventional mechanisms (not shown). A remote device R is employed to provide selective signals to the electronic control module 38 to control selective operation of the segments 14, 16, 18, massaging beads 34*a* and positioning panels 36. The control module 38 can also be programmed to perform the functions automatically.

It is to be understood that the present invention is not limited to the embodiments described above, but encompasses any and all embodiments within the scope of the following claims.

I claim:

1. A chair/bed appliance for the disabled consisting of:

a first segment having an upper surface with a first end and a second end;

a pillow disposed on said first segment adjacent the upper surface at the first end;

a first array of soft beads disposed on the upper surface of the first segment;

a second segment having an upper surface, a first end and a second end, the second end of the first segment being pivotally connected to the first end of the second segment;

a second array of soft beads disposed on the upper surface of the second segment, said second segment has an undersurface;

a plurality of leg members attached to the undersurface and extending downward therefrom;

a respective armrest disposed on the right and left sides of said second segment;

a plurality of tables mounted for pivoting movement in a horizontal plane and disposed above the upper surface of said second segment;

an adjustable night light mounted above the upper surface of said second segment;

a third segment having an upper surface, a first end and a second end, the second end of the second segment being pivotally connected to the first end of the third segment;

a third array of soft beads disposed on the upper surface of the third segment;

wherein each said segment has respective right and left sides;

a plurality of respective pivoting positioning panels defining the right and left sides of each segment;

a plurality of respect guard rails extending along the right and left sides of each segment; and a respective armrest disposed on the right and left sides of said second segment.

2. A chair/bed appliance for the disabled comprising:

a first segment having an upper surface, a first end and a second end;

a first array of soft beads disposed on the upper surface of the first segment;

a second segment having an upper surface, a first end and a second end, the second end of the first segment being pivotally connected to the first end of the second segment;

a second array of soft beads disposed on the upper surface of the second segment;

wherein said second segment has an undersurface;

a plurality of leg members attached to the undersurface and extending downward therefrom;

a third segment having an upper surface, a first end and a second end, the second end of the second segment being pivotally connected to the first end of the third segment; and a third array of soft beads disposed on the upper surface of the third segment.

3. The chair/bed appliance for the disabled according to claim 2, further including a pillow disposed on the upper surface adjacent the upper end of said first segment.

4. The chair/bed appliance for the disabled according to claim 2, wherein each said segment has respective right and left sides, the appliance further including respective pivoting positioning panels defining the right and left sides.

5. The chair/bed appliance for the disabled according to claim 2, wherein each said segment has respective right and left sides, the appliance further including a respective armrest disposed on the right and left sides of said second segment.

6. The chair/bed appliance for the disabled according to claim 2, wherein each said segment has respective right and left sides, the appliance further including guard rails extending along the right and left sides.

7. The chair/bed appliance for the disabled according to claim 2, further including a plurality of tables mounted for pivoting movement in a horizontal plane and disposed above the upper surface of said second segment.

8. The chair/bed appliance for the disabled according to claim 2, further including an adjustable night light mounted above the upper surface of said second segment.

9. A chair/bed appliance for the disabled comprising:

a first segment having an upper surface, a first end and a second end;

a first array of soft beads disposed on the upper surface of the first segment, the first array of soft beads being selectively movable in rotary and vibratory motions;

a pillow disposed on the upper surface adjacent the first end;

a second segment having an upper surface, an undersurface, a first end and a second end, the second end of the first segment being mounted for pivotal movement to the first end of the second segment;

a second array of soft beads disposed on the upper surface of the second segment, the second array of soft beads being selectively movable in rotary and vibratory motions;

a plurality of leg members attached to the undersurface of the second segment and extending downward therefrom;

respective wheels defining the lower ends of each of the leg members;

a third segment having an upper surface, a first end and a second end, the second end of the second segment being mounted for pivotal movement to the first end of the third segment; and a third array of soft beads disposed on the upper surface of the third segment, the third array of soft beads being selectively movable in rotary and vibratory motions.

10. The chair/bed appliance for the disabled according to claim 9, wherein each said segment has respective right and left sides, the appliance further including respective pivoting positioning panels defining the right and left sides.

11. The chair/bed appliance for the disabled according to claim 10, further including an electronic control module mounted on the appliance for selectively controlling rotary and vibratory motions of the first, second, and third array of soft beads and pivotal movement of the segments and the positioning panels.

12. The chair/bed appliance for the disabled according to claim 11, further including a respective arm rest disposed on the right and left sides of said second segment.

13. The chair/bed appliance for the disabled according to claim 11, further including guard rails extending along the right and left sides.

14. The chair/bed appliance for the disabled according to claim 11, further including a plurality of tables mounted for pivoting movement in a horizontal plane and disposed above the upper surface of said second segment.

15. The chair/bed appliance for the disabled according to claim 11, further including an adjustable night light mounted above the upper surface of said second segment.

* * * * *